US006042896A

United States Patent [19]

Rodriguez et al.

[11] Patent Number: 6,042,896

[45] Date of Patent: Mar. 28, 2000

[54] PREVENTING RADIOACTIVE CONTAMINATION OF POROUS SURFACES

[75] Inventors: Louis Rodriguez; Geoffrey Dearnaley, both of San Antonio, Tex.

[73] Assignee: Southwest Research Institute, San Antonio, Tex.

[21] Appl. No.: 09/322,097

[22] Filed: May 28, 1999

Related U.S. Application Data

[60] Continuation-in-part of application No. 09/026,451, Feb. 19, 1998, Pat. No. 6,001,481, which is a division of application No. 08/662,728, Jun. 10, 1996, Pat. No. 5,863,621, which is a continuation-in-part of application No. 08/400,612, Mar. 8, 1995, abandoned.

[51] Int. Cl.[7] ..... C23C 14/00

[52] U.S. Cl. ..... 427/523; 427/5; 427/249.2; 427/249.7; 427/255.4; 427/295; 427/318; 427/327; 427/350; 427/399; 427/402; 427/528; 427/529; 427/533; 427/558; 427/595

[58] Field of Search ..... 427/523, 5, 249.2, 427/249.7, 255.4, 295, 318, 327, 350, 399, 402, 528, 529, 533, 558, 595

[56] References Cited

U.S. PATENT DOCUMENTS

| | | | |
|---|---|---|---|
| 3,715,211 | 2/1973 | Quintance . | |
| 3,734,784 | 5/1973 | Bereday et al. . | |
| 4,022,925 | 5/1977 | Reuter et al. . | |
| 4,225,398 | 9/1980 | Hasegawa et al. . | |
| 4,483,751 | 11/1984 | Murayaman et al. . | |
| 4,537,793 | 8/1985 | Kehrer et al. . | |
| 4,660,297 | 4/1987 | Danielson . | |
| 5,000,831 | 3/1991 | Osawa et al. . | |
| 5,102,689 | 4/1992 | Bachmann et al. | 427/45.1 |
| 5,116,592 | 5/1992 | Wienberg . | |
| 5,230,929 | 7/1993 | Caporiccio et al. | 427/536 |
| 5,238,705 | 8/1993 | Hayashi et al. . | |
| 5,249,554 | 10/1993 | Tamor et al. . | |
| 5,279,866 | 1/1994 | Bourget et al. | 427/575 |
| 5,391,407 | 2/1995 | Dearnaley | 427/527 |
| 5,449,921 | 9/1995 | Hur et al. . | |
| 5,501,745 | 3/1996 | Dearnaley | 136/258 |
| 5,506,446 | 4/1996 | Hoffman et al. . | |
| 5,512,330 | 4/1996 | Dearnaley . | |
| 5,523,121 | 6/1996 | Anthony et al. . | |
| 5,631,087 | 5/1997 | Fukuda et al. . | |
| 5,728,465 | 3/1998 | Dorfman et al. . | |
| 5,740,941 | 4/1998 | Lemelson . | |
| 5,863,621 | 1/1999 | Dearnaley . | |

FOREIGN PATENT DOCUMENTS

| | | |
|---|---|---|
| 49-5822 | 2/1974 | Japan . |

OTHER PUBLICATIONS

C. Bedell, et al., Diamond–like Carbon from the ion–beam decomposition of plyphenyl ether.: *Applications of Diamond Films & Related Materials*, 833–838 (1991) Elsevier, (No month avail.).

G. Dearnaley, "Materials Science Aspects of Ion Beam Technology." Surface Engineering (1991) vol. 7, No. 2, (No month avail.).

K. Legg, "Surface Engineering with Ion–Assisted Coatings", *Nuclear Instruments and Methods in Physics Research* 824/25 (1987) 565–567, (No month avail.).

"Diamond coating may be future of tool manufacture" *San Antonio Express News*, Apr. 1, 1996.

Browne, Malcolm W., "Diamond Coating May be Future of Tool Manufacture", *Article in San Antonio Express News* (Apr. 1, 1996).

G. Herzberg, "Molecular Spectra and Molecular Structure, III. Electronic Spectra and Electronic Structure of Polyatomic Moleculres", Chapter V "Electronic Spectra of Individual Molecules and Their Interpretation, 1. Triatomic Molecules", pp. 488–513 (D. Van Nostrand Co. 1996) (no month avail.).

*Primary Examiner*—Bernard Pianalto

*Attorney, Agent, or Firm*—Paula D. Morris & Associates, P.C.

[57] ABSTRACT

A method for preventing radioactive contamination of porous surfaces comprising providing an apparatus for handling radioactive material comprising a porous surface; exposing the porous surface to a vacuum; depositing a flowable precursor material onto the porous surface, wherein the porous surface comprises pores and the vacuum is effective to substantially fill the pores with the flowable precursor material; subjecting the flowable precursor material to energy sufficient to convert the flowable precursor material to an effective sealant film comprising amorphous carbon. In a preferred embodiment, the porous surface is an anodized aluminum surface.

18 Claims, No Drawings

PREVENTING RADIOACTIVE CONTAMINATION OF POROUS SURFACES

The present application is a continuation-in-part of U.S. patent application Ser. No. 09/026,451, filed Feb. 19, 1998, U.S. Pat. No. 6,001,481, which is a divisional of U.S. patent application Ser. No. 08/662,728 field Jun. 10, 1996, issued as U.S. Pat. No. 5,863,621, which is a continuation-in-part of U.S. patent application Ser. No. 08/400,612, filed Mar. 8, 1995, abandoned.

FIELD OF THE INVENTION

The present invention is directed to a method for preventing contamination of porous surfaces, preferably on equipment used to handle radioactive material, such as nuclear waste.

BACKGROUND OF THE INVENTION

Safe handling and disposal of radioactive material, such as nuclear waste, is an issue of great concern to society as a whole. Much attention has been focused on how to dispose of radioactive waste. Less attention has been focused on how to prevent radioactive contamination of porous surfaces of equipment used to handle radioactive material. Unfortunately, much of this handling equipment is made of anodized aluminum, which has a highly porous surface.

A substantially transparent "natural" oxide layer forms at the surface of aluminum upon exposure to air. The oxide layer prevents direct contact between the underlying aluminum and corrosive materials in the surrounding environment. Unfortunately, this "natural oxide" layer does not always have a uniform thickness. Because of this, natural oxides generally are removed from aluminum products, and the product then is "anodized," or controllably oxidized, to provide a protective oxide layer with better quality and substantially greater thickness.

Anodizing processes generally involve the use of a bath containing an electrolyte, such as sulfuric acid, oxalic acid, chromic acid, phosphoric acid, or combinations thereof, with or without certain addition agents. The aluminum workpiece generally is used as an anode and a component made of steel or other suitable material is used as a cathode. The anode and cathode are immersed in the electrolyte solution, and a direct or alternating current is passed through the electrolyte.

Although anodizing imparts satisfactory corrosion resistance to aluminum components, anodizing also suffers from several disadvantages. One disadvantage is the porosity of the resulting surface oxide. A typical anodizing treatment results in a porous polygonal cellular microstructure superimposed on a thin (less than 100 nm) "barrier" layer. The diameter of the pores in the microstructure can be as small as 10 nm. The cell dimension can be as small as about 30 nm.

The pores formed at the surface of anodized aluminum are undesirable because they tend to serve as corrosion sites which give rise to deep pits, and can result in "blooms" or white spots on the surface of the aluminum. Where the aluminum equipment handles radioactive material, the pores in the anodized aluminum surface can create a particularly acute problem. If the pores are not adequately sealed, then radioactive material can become trapped in the pores, rendering the equipment unsafe.

The pores of anodized aluminum customarily are sealed by immersion in a hot Solution containing hexavalent chromium. A solid compound of chromium, aluminum, oxygen, and some hydrogen forms within the pores. This solid compound seals the pores against penetration by corrosive agents. Unfortunately, the process does not purge the pores at the surface of the aluminum before or while the chromate sealant is formed. As a result, at least some gas remains in many of the pores, allowing the pores to serve as corrosion sites. Where the surface contacts radioactive material during use, these same sites may accumulate radioactive contamination. Hexavalent chromium solutions also are toxic, and their use and disposal creates additional environmental concerns.

The present invention provides an effective and non-toxic method for preventing radioactive contamination of porous surfaces—preferably anodized aluminum surfaces.

SUMMARY OF THE INVENTION

A method for preventing radioactive contamination of porous surfaces comprising providing an apparatus for handling radioactive material comprising a porous surface, exposing the porous surface to a vacuum, depositing a flowable precursor material onto the porous surface, wherein the porous surface comprises pores and the vacuum is effective to substantially fill the pores with the flowable precursor material; subjecting the flowable precursor material to energy sufficient to convert the flowable precursor material to an effective sealant film comprising amorphous carbon. In a preferred embodiment, the porous surface is an anodized aluminum surface.

DETAILED DESCRIPTION OF THE INVENTION

The present invention provides a method for preventing contamination of porous surfaces by radioactive material by sealing the pores in those surfaces with amorphous or "diamond-like" carbon using vacuum deposition techniques. As used herein, the terms "diamond-like" carbon and "amorphous" carbon refer to a carbonaceous material composed of a mixture of "$sp^2$" and "$sp^3$" bonded carbon. "$Sp^2$" bonded carbon refers to double bonded carbon commonly associated with graphite. "$Sp^3$" bonded carbon refers to single bonded carbon commonly associated with diamond. Unlike diamond, amorphous or "diamond-like" carbon does not possess a highly ordered crystalline structure. Amorphous carbon generally takes the form of small nanometer sized (or larger) islands of graphite dispersed within an amorphous matrix of $sp^3$ bonded carbon.

Depending upon the method of deposition, the amorphous carbon may be essentially 100% carbon or may have a sizeable amount (up to 50 atomic %) of C—H bonded hydrogen. The term "diamond-like" often is used to describe the bulk mechanical properties of the amorphous carbon, specifically its hardness (anywhere from 10–40% of the hardness of crystalline diamond) and its low coefficient of friction under dry sliding conditions (frequently <0.1). Amorphous carbon does not usually exist in bulk form, but is deposited as a coating or film by such methods as ion beam assisted deposition, direct ion beam deposition, magnetron sputtering, ion sputtering, chemical vapor deposition, plasma enhanced chemical vapor deposition, cathodic arc deposition, and pulsed laser deposition.

A preferred embodiment of the invention involves using vacuum deposition techniques to deposit amorphous carbon and seal the pores in porous anodized aluminum surfaces on equipment used to handle radioactive material. As used herein, the word "aluminum" is defined to mean aluminum and alloys thereof that are amenable to anodization. According to the invention, a flowable precursor material is applied to the porous anodized aluminum surface in a vacuum, as explained more fully below. The application of the precursor material in a vacuum draws the flowable precursor material into the pores in the surface of the anodized aluminum, pushing out any remaining gas in the pores and substantially filling the pores. The precursor material then is converted into a amorphous carbon by application of energy, preferably in the form of an ion beam. The result is an adherent interface between the anodized aluminum surface and the a amorphous carbon sealant. The resulting sealant is chemically inert and impermeable, has a low coefficient of friction, and forms a mechanically strong surface that will withstand exposure to high temperatures and friction.

Because the amorphous carbonaceous sealant is relatively hydrophobic, it is important to treat the anodized aluminum surface to remove any adsorbed water molecules before applying the sealant. It was determined that water molecules have a much higher coefficient of absorption for UV light with a shorter wavelength, in the region of 120–150 nm, than for the longer wavelength UV light produced by conventional UV lamps. Exposure of adsorbed water molecules to low intensity UV light was found to result in more rapid, and more effective desorption of water molecules from the anodized aluminum surface.

Short wavelength UV radiation can be obtained using unconventional UV lamps, such as deuterium discharge lamps. Deuterium discharge lamps generate UV radiation having wavelengths down to 120 nm. These lower wavelength UV lamps can be modified, using special windows formed of substances such as magnesium fluoride, to transmit radiation down to wavelengths of about 110 nm.

To treat an anodized aluminum component, the component should placed in a vacuum chamber which preferably is provided with. (a) a source of short wavelength low intensity UV radiation, (b) a reservoir for vaporizing the precursor sealant fluid and directing the vapor onto the component; and (c) an ion gun or other suitable apparatus for accelerating ions and bombarding the component with an energetic beam of ions.

The pressure in the vacuum chamber should be pumped down to at least about $10^{-6}$ torr. In a preferred embodiment, a 150 watt UV lamp is used to produce UV radiation in the range of about 110–180 nm, preferably between about 120–150 nm. The surface of the anodized aluminum should be exposed to a flux of this low intensity UV radiation for a time sufficient to remove adsorbed water molecules from the anodized surface. Using a 150 watt lamp and 120–150 nm UV light, this should take about 20 minutes.

The precursor material is placed in a reservoir and exposed to a suitable form and amount of energy to vaporize the precursor material. Any of a number of energy sources and types may be used to vaporize the precursor material. Suitable energy sources include an ion beam, an electron beam, electrical resistance heating, a laser beam, electromagnetic energy, and other sources. In a preferred embodiment, the vacuum chamber reservoir is supplied with electrical resistance heating.

Diffusion pump fluids commonly Are used as precursor materials for the formation of amorphous carbon. Diffusion pump fluids have a low vapor pressure and can be vaporized stably at room temperature. Examples of diffusion pump fluids which may be used as precursor materials in the present invention include, but are not necessarily limited to: polyphenyl ether; elcosyl naphthalene; i-diamyl phthalate; i-diamyl sebacate; chlorinated hydrocarbons, n-dibutyl phthalate; n-dibutyl sebacate; 2-ethyl hexyl sebacate; 2-ethyl hexyl phthalate; di-2-ethyl-hexyl sebacate; tri-m-cresyl phosphate; tri-p-cresyl phosphate;0 dibenzyl sebacate. Other suitable precursor materials are the vacuum-distilled hydrocarbon mineral oils manufactured by Shell Oil Company under the trademark APIEZON, and siloxanes, such as polydimethyl siloxane, pentaphenyl-trimethyl siloxane, and other silicon containing diffusion pump fluids, preferably pentaphenyl-trimethyl siloxane.

The precursor material is placed in a suitable reservoir for vaporization. The reservoir is heated to an appropriate temperature to vaporize the precursor material. The resulting vapor flux is directed toward the surface to be sealed, for example, through an aperture or nozzle, until a preferred coating thickness of between about 1–5 microns is achieved. The thickness of the coating may be monitored by standard methods, e.g. using the frequency change of a quartz crystal oscillator.

In order to decompose the precursor material to form the amorphous carbon, the component is subjected to sufficient energy to ionize the constituent molecules in the precursor material, and to rupture the bonds between hydrogen and other atoms, such as carbon, silicon, sulfur, etc., thereby releasing the hydrogen into the surrounding vacuum to be pumped away. In a preferred embodiment, the component is bombarded with an energetic beam of ions, preferably substantially simultaneously with vapor deposition of the precursor material. The bombardment may be either in a continuous or interrupted fashion. The ions preferably are ionized gaseous species such as hydrogen, helium, neon, nitrogen, argon, methane, carbon monoxide, or other relatively low mass gaseous elements or compounds. The energy of bombardment required to rupture the necessary bonds ranges from about 1 keV to about 1 MeV, preferably from about 20 keV to about 100 keV The "ion arrival ratio" is controlled in relation to the rate of arrival of the precursor molecules. The "ion arrival ratio" is defined as the ratio of each arriving ion to the number of precursor molecules present at the surface of the component. The ion arrival ratio preferably should be at least 1 ion for every molecule of precursor. This process should require about one ion for every 100 atoms in the final product coating; however, the required ion-to-atom ratio will vary according to the mass and energy of the ion species. Typically, 100 eV must be deposited for each carbon atom in the coating. Persons of ordinary skill in the art can relate the ion beam current per unit area to the arrival rate of precursor molecules.

The ion bombardment is continued until the precursor molecules are ionized and converted into an inert, solid, impermeable, mechanically strong material. The amount of time required to achieve this conversion varies with the intensity of the ion beam. At an ion-to-atom ratio of 1 to 100 and an energy of about 20 keV to about 100 keV, about 30 minutes of ion bombardment should be sufficient.

Persons of skill in the art will appreciate that many modifications may be made to the embodiments described herein without departing from the spirit of the present invention. Accordingly, the embodiments described herein are illustrative only and are not intended to limit the scope of the present invention.

We claim:

1. A method for preventing radioactive contamination of porous surfaces comprising:

providing an apparatus for handling radioactive material comprising a porous surface;

exposing said porous surface to a vacuum;

depositing a flowable precursor material onto said porous surface, wherein said porous surface comprises pores and said vacuum is effective to substantially fill said pores with said flowable precursor material;

subjecting said flowable precursor material to energy sufficient to convert said flowable precursor material to an effective sealant film comprising amorphous carbon.

2. The method of claim 1 wherein said vacuum is about $10^{-6}$ torr.

3. The method of claim 2 wherein said depositing a flowable precursor material comprises condensing a vapor of said flowable precursor material.

4. The method of claim 3 wherein said subjecting said flowable precursor material to energy sufficient to convert said flowable precursor material to an effective sealant film comprising amorphous carbon comprises substantially simultaneously bombarding said flowable precursor with an energetic beam of ions at an energy, for a time, and at a linear energy of transfer sufficient to convert said flowable precursor material to sealant film.

5. The method of claim 4 wherein said energy is between about 1 keV to about 1 Mev.

6. A method for preventing radioactive contamination of an anodized aluminum surface comprising:

providing an apparatus for handling radioactive material comprising an anodized aluminum surface;

exposing said anodized aluminum surface to a vacuum;

depositing a flowable precursor material onto said anodized aluminum surface, wherein said anodized aluminum surface comprises pores and said vacuum is effective to substantially fill said pores with said flowable precursor material;

subjecting said flowable precursor material to energy sufficient to convert said flowable precursor material to an effective sealant film comprising amorphous carbon.

7. The method of claim 6 comprising an interface between said anodized aluminum surface and said sealant film, wherein said interface is substantially free of imperfections attributable to water molecules remaining adsorbed to said surface during application of said sealant film.

8. The method of claim 7 wherein said vacuum is about $10^{-6}$ torr.

9. The method of claim 8 wherein said depositing a flowable precursor material comprises condensing a vapor of said flowable precursor material.

10. The method of claim 9 wherein said subjecting said flowable precursor material to energy sufficient to convert said flowable precursor material to an effective sealant film comprising amorphous carbon comprises substantially simultaneously bombarding said flowable precursor with an energetic beam of ions at an energy, for a time, and at a linear energy of transfer sufficient to convert said flowable precursor material to sealant film.

11. The method of claim 10 wherein said energy is between about 1 keV to about 1 Mev.

12. The method of claim 6 wherein said vacuum is about $10^{-6}$ torr.

13. The method of claim 12 wherein said depositing a flowable precursor material comprises condensing a vapor of said flowable precursor material.

14. The method of claim 13 wherein said subjecting said flowable precursor material to energy sufficient to convert said flowable precursor material to an effective sealant film comprising amorphous carbon comprises substantially simultaneously bombarding said flowable precursor with an energetic beam of ions at an energy, for a time, and at a linear energy of transfer sufficient to convert said flowable precursor material to sealant film.

15. A method for preventing radioactive contamination of an anodized aluminum surface comprising:

providing an apparatus for handling radioactive material comprising an anodized aluminum surface;

exposing said anodized aluminum surface to a vacuum of about $10^{-6}$ torr;

condensing a vapor of a flowable precursor material onto said anodized aluminum surface, wherein said anodized aluminum surface comprises pores and said vacuum is effective to substantially fill said pores with said flowable precursor material;

substantially simultaneously bombarding said flowable precursor material with an energetic beam of ions at an energy, for a time, and at a linear energy of transfer sufficient to convert said flowable precursor material to a sealant film.

16. The method of claim 15 wherein said energy is between about 1 keV to about 1 Mev.

17. The method of claim 16 comprising an interface between said anodized aluminum surface and said sealant film, wherein said interface is substantially free of imperfections attributable to water molecules remaining adsorbed to said surface during application of said sealant film.

18. The method of claim 15 comprising an interface between said anodized aluminum surface and said sealant film, wherein said interface is substantially free of imperfections attributable to water molecules remaining adsorbed to said surface during application of said sealant film.

* * * * *